US006776409B2

(12) United States Patent
Cook

(10) Patent No.: US 6,776,409 B2
(45) Date of Patent: Aug. 17, 2004

(54) BATCH SHEET FEEDING

(75) Inventor: Edward J. Cook, Toronto (CA)

(73) Assignee: Longford Equipment International Limited, Scarborough (CA)

( * ) Notice: Subject to any disclaimer, the term of this patent is extended or adjusted under 35 U.S.C. 154(b) by 0 days.

(21) Appl. No.: 10/222,895

(22) Filed: Aug. 19, 2002

(65) Prior Publication Data

US 2004/0032079 A1 Feb. 19, 2004

(30) Foreign Application Priority Data

Jun. 28, 2002 (CA) ..... 2392237

(51) Int. Cl.[7] ..... B65H 29/00

(52) U.S. Cl. ..... 271/189; 271/273; 271/207; 271/198; 414/789; 414/790.7

(58) Field of Search ..... 271/189, 246, 271/253, 273, 207, 176, 198, 199, 3.1, 220; 414/789, 790.7

(56) References Cited

U.S. PATENT DOCUMENTS

| | | | | | |
|---|---|---|---|---|---|
| 4,651,983 | A | | 3/1987 | Long | 271/35 |
| 4,803,516 | A | | 2/1989 | Watanabe et al. | 355/4 |
| 4,925,362 | A | * | 5/1990 | Golicz | 414/790.7 |
| 5,078,666 | A | | 1/1992 | Porret et al. | 493/1 |
| 5,147,092 | A | * | 9/1992 | Driscoll et al. | 271/184 |
| 5,178,379 | A | * | 1/1993 | Edwards et al. | 271/189 |
| 5,244,200 | A | * | 9/1993 | Manzke | 271/198 |
| 5,364,085 | A | * | 11/1994 | Kennish | 270/58.02 |
| 5,375,825 | A | * | 12/1994 | Kennish | 270/58.02 |
| 5,433,431 | A | * | 7/1995 | Lowell | 271/273 |
| 5,484,255 | A | * | 1/1996 | Lowell | 414/789 |
| 5,721,627 | A | | 2/1998 | Kamiya | 358/496 |
| 5,775,689 | A | * | 7/1998 | Moser et al. | 271/198 |
| 6,203,006 | B1 | * | 3/2001 | Semanick et al. | 271/213 |
| 6,386,537 | B1 | * | 5/2002 | Howard et al. | 271/303 |
| 6,491,492 | B1 | | 12/2002 | Cook | 414/789.9 |
| 6,519,503 | B2 | * | 2/2003 | Paterson et al. | 700/226 |

FOREIGN PATENT DOCUMENTS

| | | | | |
|---|---|---|---|---|
| EP | 1084977 A2 | * | 3/2001 | B65H/31/28 |
| JP | 2000331221 A | * | 11/2000 | G07D/9/04 |

* cited by examiner

*Primary Examiner*—Patrick Mackey

(57) ABSTRACT

A batch sheet feeder has an upstream first conveyor section arranged to convey sheets singly in a downstream direction to a downstream second conveyor section. The second conveyor section has an upper second conveying section and a lower second conveying section forming a gap therebetween. The gap is largest at an upstream end of the second conveyor section and diminishes in size toward a downstream end of the second conveyor section. A gate positioned proximate the downstream end of the second conveyor section selectively blocks sheets fed along the second conveyor section. In another embodiment, the sheet feeder has a sheet conveyor, sheet sensor, and visual attribute sensor. The visual attribute sensor has a field of view covering an area of the conveyor at a certain downstream location so as to sense an area of any sheet on the conveyor at this downstream location. The visual attribute sensor can compare a sensed area of a sheet at the downstream location with a stored visual attribute. In this way, where the sheets of a batch are different, the visual attribute sensor can be used to verify that a sheet of a batch has visual characteristics matching those of the expected sheet at that ordinal position in the batch. This assists in ensuring a batch is not faulty. In a related method of verifying batches of sheets, for each sheet at a given ordinal position in each batch a visual attribute measure for at least an area of the sheet is obtained. A comparison is made of the visual attribute measure with a stored visual attribute measure. Each batch is selectively verified based on this comparison.

17 Claims, 6 Drawing Sheets

BATCH SHEET FEEDING

FIELD OF THE INVENTION

This invention relates to a sheet feeder particularly useful in feeding batches of sheets and to a method of verifying batches of sheets.

BACKGROUND OF THE INVENTION

In known batch sheet feeders, sheets may be fed singly from a stack through parallel belts and counted while they are transported through the parallel belts. The sheets are then either fed individually to a target (e.g., a box between flights of a downstream conveyor) so as to be stacked in batches directly on the target, or fed and stacked onto some sort of drop table (e.g., a reciprocating table) to be dropped vertically onto or into their target as a batch.

One drawback with singly feeding sheets to the target is that the target area must not move or be obstructed during the entire time that a given batch is being fed. By stacking the batch on a drop table, this problem is avoided in that the entire batch is dropped to the target together as one group. However, the speed at which the batch drops is fixed (by gravity) and the feeding of sheets to the table must halt for the time it takes the drop table to open, the product to drop and the table to return to its ready position. Another drawback is that the target must be able to accept the product from the top. With both approaches, a further difficulty in stacking the sheets is in controlling the trailing edge of a sheet so that the next sheet does not crash into it. This difficulty increases with the speed of feeding.

While known batch sheet feeders count sheets to ensure there is a proper number of sheets in each batch, in many applications the sheets of a batch are printed differently. Thus, each sheet of a batch may be unique in the batch. In such applications, another problem is ensuring that each batch has a proper set of sheets. Another drawback with the noted types of batch sheet feeder is that they have no mechanism to address this problem.

This invention seeks to provide a batch sheet feeder that avoids at least one of these drawbacks.

SUMMARY OF INVENTION

According to the present invention, there is provided a batch sheet feeder comprising: an upstream first conveyor section arranged to convey sheets singly in a downstream direction to a downstream second conveyor section; said second conveyor section comprised of an upper second conveying section and a lower second conveying section forming a gap therebetween, said gap being largest at an upstream end of said second conveyor section and diminishing in size toward a downstream end of said second conveyor section; and a gate positioned proximate said downstream end of said second conveyor section for selectively blocking sheets from exiting said second conveyor section.

According to another aspect of the invention, there is provided a batch sheet feeder, comprising: a lower endless conveyor; an upper endless conveyor arranged with respect to said lower conveyor so as to form a sheet feed path between said lower conveyor and said upper conveyor for feeding sheets in a downstream direction; said lower conveyor substantially paralleling said upper conveyor along an upstream first section, said lower conveyor jogging away from said upper conveyor at an upstream end of a downstream second section so as to form a gap between said lower conveyor and said upper conveyor at said second section that is larger than any gap between said lower conveyor and said upper conveyor at said first section.

According to a further aspect of the invention, there is provided a sheet feeder, comprising: a sheet conveyor; a sheet sensor; a visual attribute sensor having a field of view covering an area of said conveyor at a certain downstream location so as to sense an area of any sheet on said conveyor at said downstream location, said visual attribute sensor for comparing a sensed area of a sheet at said downstream location with a stored visual attribute.

According to another aspect of the present invention, there is provided a method of verifying batches of sheets, comprising: for each sheet at a given sheet position in each batch of sheets: obtaining a visual attribute for at least an area of said each sheet; comparing said visual attribute with a stored visual attribute; and selectively verifying said each batch based on said comparing.

According to a further aspect of the invention, there is provided a method of verifying batches of sheets, comprising: conveying sheets in a sheet conveyor; sensing sheets with a sheet sensor; sensing a visual attribute with a visual attribute sensor having a field of view covering an area of said conveyor at a certain downstream location so as to sense an area of any sheet on said conveyor at said downstream location; verifying batches of sheets at a processor receiving an output from said visual attribute sensor and said sheet sensor.

Other features and advantages of the invention will be apparent after reviewing the description in conjunction with the accompanying drawings.

DESCRIPTION OF THE DRAWINGS

In the figures which illustrate example embodiments of the invention.

DETAILED DESCRIPTION

Figure 1:
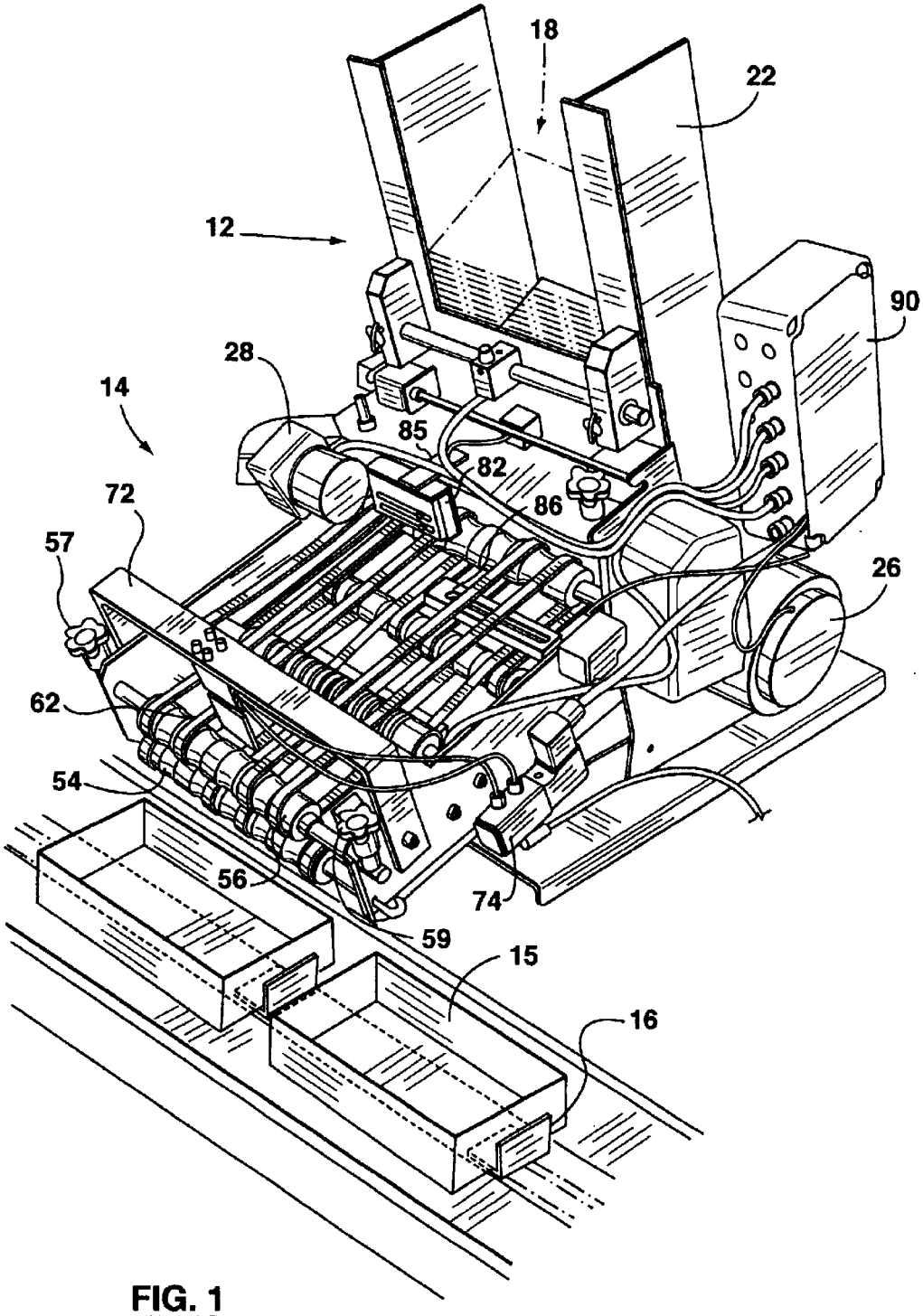
FIG. 1 is a perspective view of a sheet feeder made in accordance with this invention.
Figure 2:
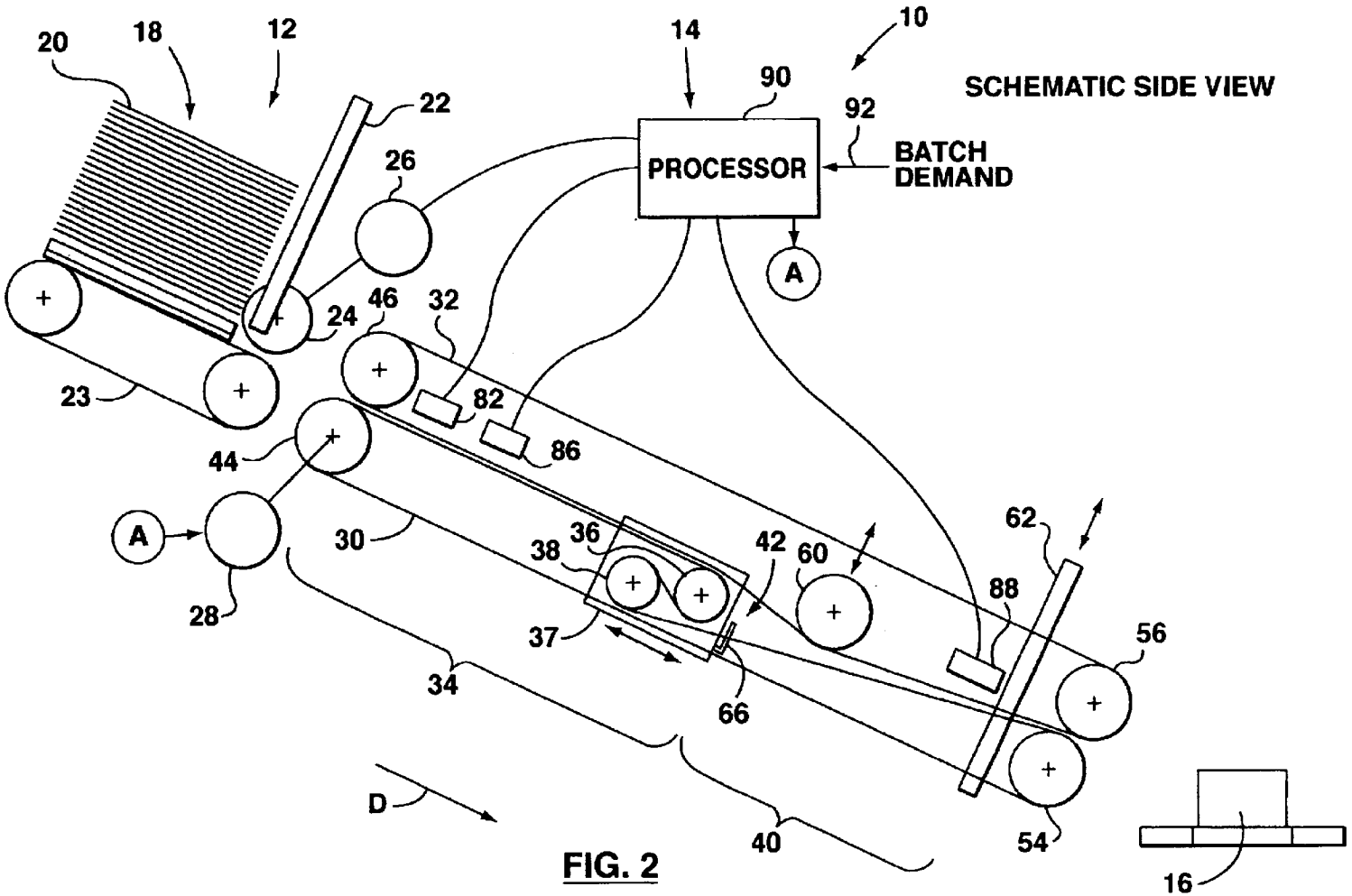
FIGS. 2 and 2*a* are schematic side views of FIG. 1.

Referencing FIGS. 1 and 2, sheet handling apparatus 10 comprises an in-feed sheet feeder 12, a batch sheet feeder 14, and a downstream target, such as boxes 15 between flights of flight conveyor 16.

The in-feed sheet feeder may be of any type that will feed sheets singly to batch sheet feeder 14. As illustrated, in-feed sheet feeder 12 has a stack 18 of sheets 20 supported by sheet guides 22 arranged such that the bottom sheet contacts a feed belt 23. A motor 26 is provided to rotate a feed wheel 24. If feed belt 23 is circulating, rotation of wheel 24 through an arc will feed a single sheet downstream. Such an in-feed sheet feeder 12 is further described in U.S. Pat. No. 4,651,983 to Long, the contents of which are incorporated by reference herein.

The batch sheet feeder 14 feeds sheets in a downstream direction D from the in-feed sheet feeder 12 to conveyor 16.

The batch sheet feeder 14 has a lower endless conveyor 30 and an upper endless conveyor 32 forming a sheet feed path between them. The conveyors 30, 32 are driven by a motor 28. Motor 28 also drives feed belt 23. As is apparent from FIGS. 1 and 3, each of these conveyors comprises a plurality of endless belts 30B, 32B. The lower conveyor 30 substantially parallels the upper conveyor 32 along an upstream first section 34. The lower conveyor 30 then wraps around separating support rolls 36, 38 to jog away from the upper conveyor 32. The separating support rolls are mounted on a base 37, as is a backstop 66; the base allows the downstream position of the separating support rolls (and the backstop) to be adjusted. The separating support rolls define an upstream end of a downstream second section 40 of the batch sheet feeder. With this arrangement, any gap between the upper 32 and lower 30 conveyors at the first section 34 is smaller than the gap 42 between these conveyors at the upstream end of the second section 40.

The upstream end of the lower 30 and upper 32 conveyors is supported by in-feed support rolls 44, 46, respectively. The downstream end of these conveyors is supported by exit rolls 54, 56, respectively. Exit rolls 56, 58 are mounted so that their spacing can be adjusted to some extent by screws 57, 59. However, any gap between the exit rolls 54, 56 should be significantly smaller than gap 42 at the upstream end of second section 40. In consequence, the gap 42 between the lower 30 and upper 32 conveyors is largest at the upstream end of the second section 40 and reduces in size toward the downstream end of the second section 40.

An adjustable support roll 60 bears against the upper conveyor 32 at the second section 40. The adjustable support roll may be adjusted in a direction toward or away from the lower conveyor 30 in order to selectively adjust the size of the gap 42 between the lower 30 and upper 32 conveyors.

Separating support roll 38 is upstream of separating support roll 36. The lower conveyor 30 wraps around a downstream side of separating support roll 36 and around an upstream side of separating support roll 38 so as to form an "S" shape in the downstream conveyor. (In the right hand side view of FIG. 2, this appears as a backwards "S" shape.)

A retractable gate 62 is positioned proximate the downstream end of the second section 40 to selectively block sheets from exiting the batch sheet feeder 14. A pneumatic valve 74 provides air pressure to reciprocate the gate. The gate depends from a bracket 72 and a guide 70 (FIG. 3) maintains the gate 62 in its proper orientation. Side sheet guides 73 (FIG. 3) are provided upstream of the gate 62.

Figure 3:
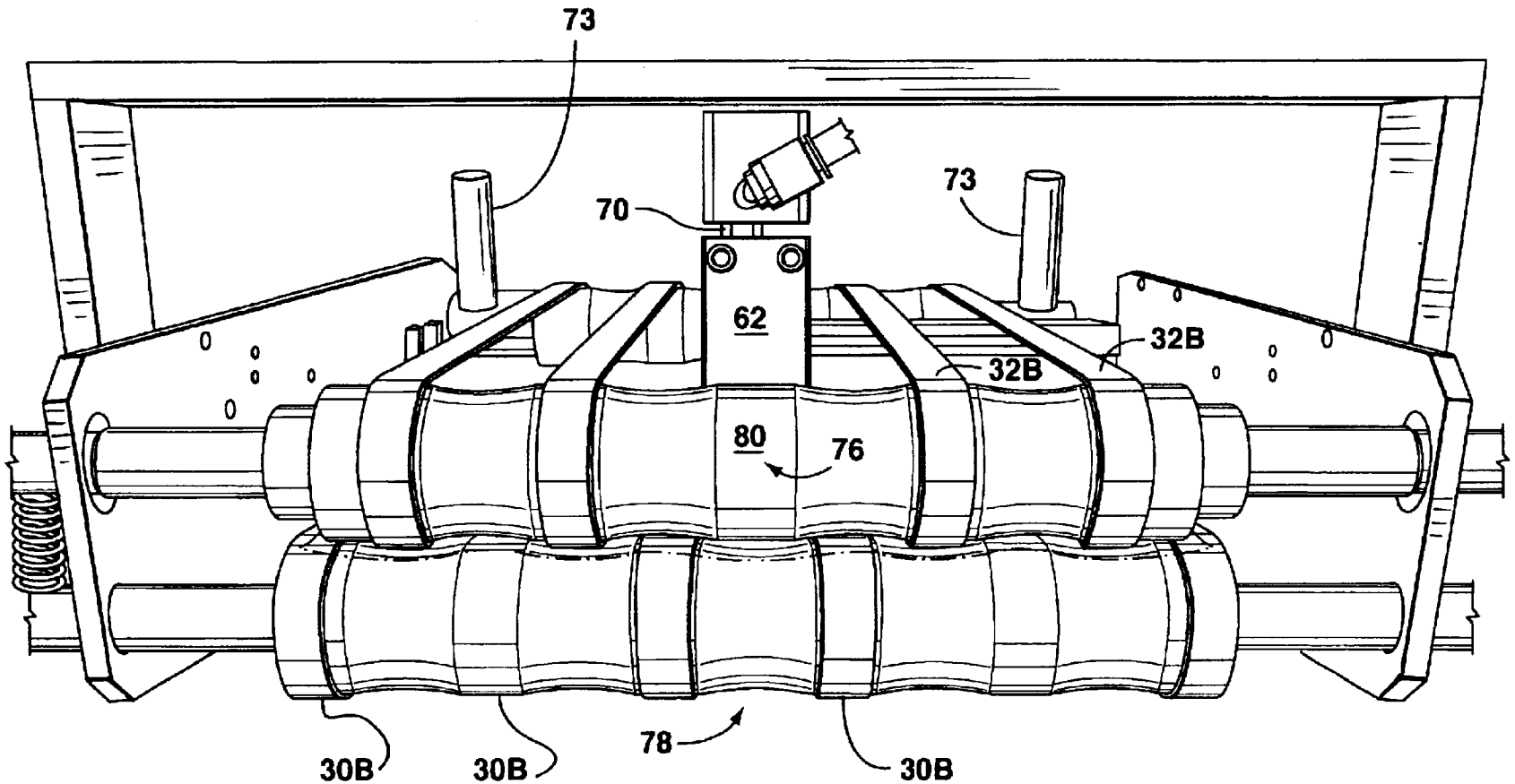
FIG. 3 is a perspective end view of a portion of the feeder of FIG. 1.

With reference to FIG. 3, each of the exit rolls 54, 56 may be an undulating roll. These undulating rolls parallel each other with the peaks 76 of the upper undulating exit roll 56 aligned with the troughs 78 of the lower undulating roll 54. The peaks of each undulating roll have gently sloped crowns 80. Each belt 30B, 32B of the conveyors 30, 32 wraps around one of these crowns. However, in order to accommodate gate 62, no belt wraps around the central peak of the upper undulating exit roll 56. This configuration of the exit rolls 54, 56 allows the lower conveyor to project to, or above, the level of the upper conveyor at the exit rolls 54, 56. Thus, optionally, there may be no gap at all between the lower and upper conveyors at the exit rolls. Furthermore, with this arrangement, the belts self-centre on the crowns 80 of the peaks 76. Optionally, in-feed support rolls 44, 46 may be similarly configured undulating rolls.

A visual attribute sensor 82 and a sheet sensor 86 are positioned along the first section 34 of the batch sheet feeder. The visual attribute sensor may be a colour sensor of the type that, when prompted, memorises the colour currently within its field of view. After memorising a colour, the colour sensor outputs a "match" signal whenever it is subsequently prompted to sense the colour within its field of view and the colour it sees is the same as the memorised colour. A suitable colour sensor operating in this fashion is the CZ-K[198] series RGB digital fiberoptic sensor manufactured by Kayence Corporation of Japan. The visual attribute sensor has a mount 84 that allows its transverse and downstream position to be adjusted. A batch sensor 88 is positioned along the second section 40 of the batch sheet feeder.

A processor 90 receives an output signal from each of sheet sensor 86 and batch sensor 88. The processor is also coupled for communication with visual attribute sensor 82. The processor outputs control signals to each of motors 26 and 28 and pneumatic valve 74. The processor also receives batch demand signals on control line 92.

Sheet handling apparatus 10 may be operated with visual attribute sensor 82 active or inactive. It is assumed first that processor 90 is loaded with an indication visual attribute sensor is inactive. The processor is also loaded with an indication of the number of sheets that are to be in each batch and a stack 18 of sheets 20 is loaded into sheet guides 22. The downstream position of base 37 is then adjusted so that the length of gap 42 between backstop 66 and gate 62 is sufficient to accommodate the length of the sheets 20 that are in stack 18.

The processor 90 may then accumulate a first batch of sheets at the second section 40 of batch sheet feeder 14. To do so, the processor ensures gate 62 is blocking the exit of the batch sheet feeder by sending an appropriate activation signal to the pneumatic valve 74. The processor then activates motor 28 in order to circulate conveyors 30 and 32 (and feed belt 23) and motor 26 to rotate feed wheel 24 in order to feed sheets singly between the conveyors 30, 32. The conveyors 30, 32 entrain the sheets and move them in the downstream direction D toward the gate 62. As sheets 20 pass sheet-sensor 86, "sheet sensed" signals are sent to the processor. This allows the processor to keep track of the number of sheets that have been fed. After this number reaches the previously loaded number of intended sheets in each batch, the processor stops motors 26 and 28.

Figure 2A:
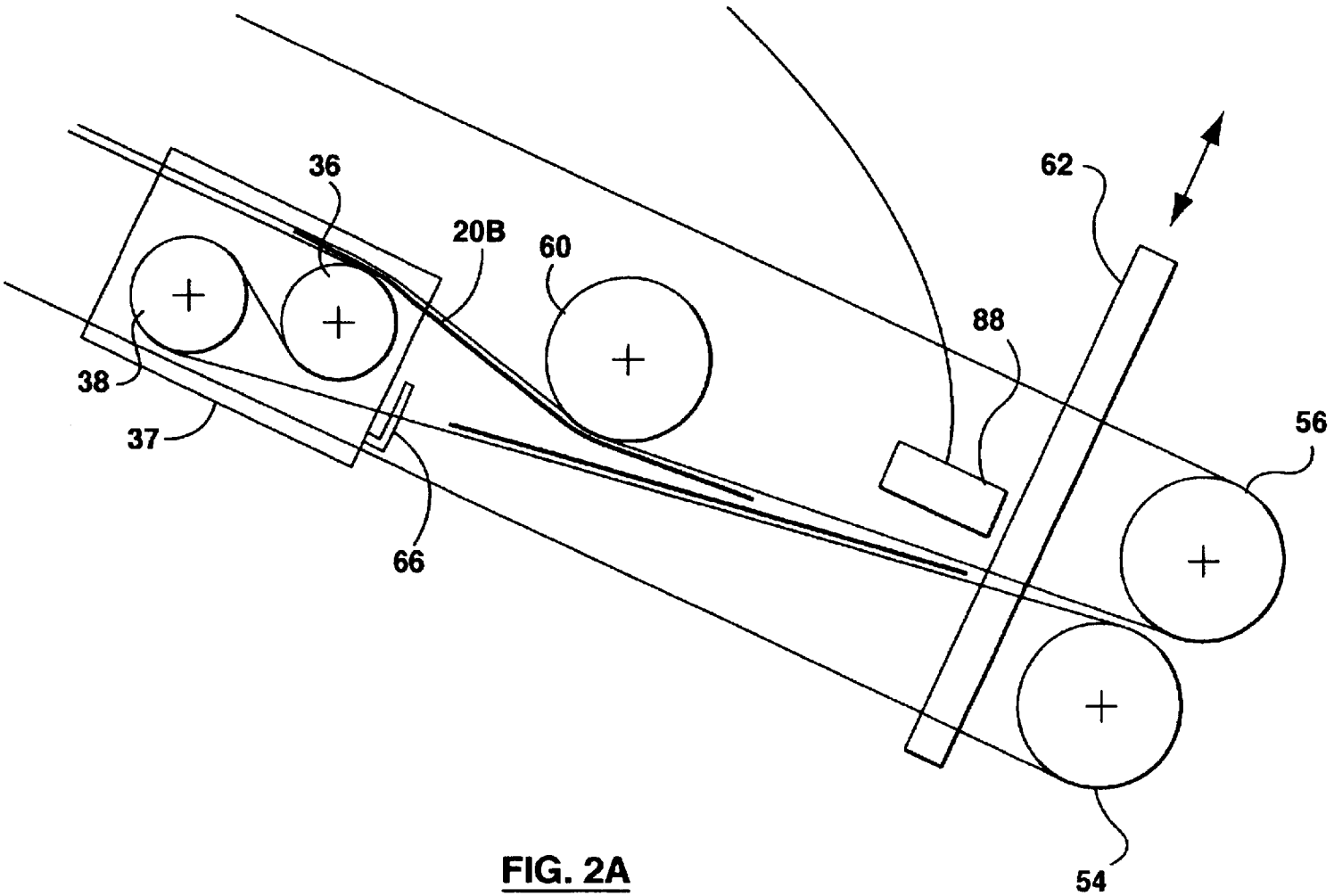

As each fed sheet passes separating support roll 36, it drops into the gap 42 between the upper 32 and lower 30 conveyors and then continues downstream until stopped by gate 62. Adjustable support roll 60 creates a bend in upper conveyor 32. This causes sheets feeding past support roll 60 to bend—as illustrated by sheet 20B in FIG. 2*a*. Once the trailing edge of a bent sheet enters gap 42, the sheet naturally begins to straighten out to lose its bend; this urges the trailing edge of the sheet downwardly, thereby reducing the risk of the next upstream sheet crashing into the trailing edge of the straightening sheet. Because of the enlarged gap between the upper and lower conveyors in the second section 40, the frictional contact of the lowermost and uppermost sheets accumulated in section 40 with respective conveyors 30 and 32 is reduced sufficiently to avoid bruising or spindling the sheets. Adjustable support roll 60 may be adjusted in accordance with the size of a batch: the larger the batch, the larger the gap 42 so as to control the frictional force on the uppermost sheet accumulated in section 40. Additionally, the spacing between exit rolls 56, 58 can also be adjusted in accordance with the size of the batch to control the frictional forces on the batch.

Backstop 66 precludes the possibility of the trailing edge of a sheet becoming entrained in the short upstream run of the lower conveyor 30 as it loops back from roll 36 to roll 38.

Once an entire batch is in gap 42 and the processor has stopped motors 26 and 28 (thereby stopping the conveyors 30, 32), the processor causes the gate 62 to be retracted. Optionally, the processor may then control motor 28 to move conveyors 30, 32 slowly in order to advance the accumulated batch sufficiently so that the batch is between the exit rolls 54, 56, whereupon the processor again stops the conveyors 30, 32. (A rotary encoder associated with motor 28 can be used to allow the processor to know how far it has advanced the batch.) In this situation, the front of the batch is tightly held between the exit rolls 54, 56 (but the trailing edge of the batch has not passed batch sensor 88).

When the processor 90 receives a batch demand signal on line 92, it activates motors 26 and 28 to again begins circulating conveyors 30 and 32 so that the batch exits to conveyor 16 through the exit rolls 54, 56. In this regard, with the upper surface of the lower conveyor belts 30B positioned below the lower surface of the upper conveyor belts 32B, the sheets in the batch will be forced to assume an undulated shape as they pass through the exit rolls. This enhances the frictional engagement of the batch of sheets with the conveyor belts 30B, 32B and thereby assists in ensuring proper feeding. (Where in-feed support rolls 44, 46 are similarly configured, in-fed sheets may also be forced to assume an undulated shape that enhances frictional engagement and thereby assists in ensuring proper feeding.)

When the trailing edge of a batch passes batch sensor 88, the batch sensor signals processor 90. This prompts the processor to extend gate 62 to again block the feed path. With both motors 26 and 28 activated, a new batch is accumulated in the second section 40 of the batch sheet feeder. The operation then repeats as aforedescribed.

The adjustment mechanism for adjustable support roll 60 may be a manually operated mechanism or an actuator controlled by processor 90. In the latter case, where the ready position of a batch (i.e., the rest position of the batch while a demand signal is awaited) is such that the trailing edge of the batch is upstream of roll 60, once a batch reaches the ready position, the processor may lower roll 60 to engage the batch more securely. This will allow a batch to be more securely ejected. Once the batch has been ejected, the processor would retract 60 back to a position for accumulation of tire next batch.

Optionally, two adjustable support rolls (not shown) may be provided at the downstream position of gate 62, one on either side of the gate. If these additional rolls are provided, they may remain in a retracted position while gate 62 blocks the feed path, but may extend to push the conveyor belts 30B or 32B with which they are associated closer together when gate 62 is retracted. These two adjustable support rolls may therefore assist in ensuring that the batch is positively fed to the exit rolls 54, 56 after the gate has been retracted. Also, if the feeder is equipped with these additional adjustable support rolls, the spacing between the exit rolls 54, 56 may be increased. The increased spacing between the exit rolls helps ensure that the exit rolls are not so tightly spaced as to jam a developing batch against the gate with a force that will spindle sheets in the batch.

In the special case where the processor is loaded with an indication that a batch comprises only a single sheet, the processor can permanently raise gate 62 and, where it can control the position of roll 60 through an actuator, can lower roll 60 so that the conveyors 30, 32 beneath the roll will pinch a single sheet. The operation of feeder 14 would also differ in that processor would simply operate motors 26 and 28 until batch sensor 88 is interrupted by a single sheet. Thereafter, on receipt of a demand signal, the sheet interrupting the batch sensor would be ejected and feeding would resume until the next sheet interrupted the batch sensor 88.

Optionally, motors 26 and 28 could be replaced by a single motor with an appropriate drive train to obtain a desired speed ratio between (slower moving) feed wheel 24 and conveyors 30, 32.

Figure 4:
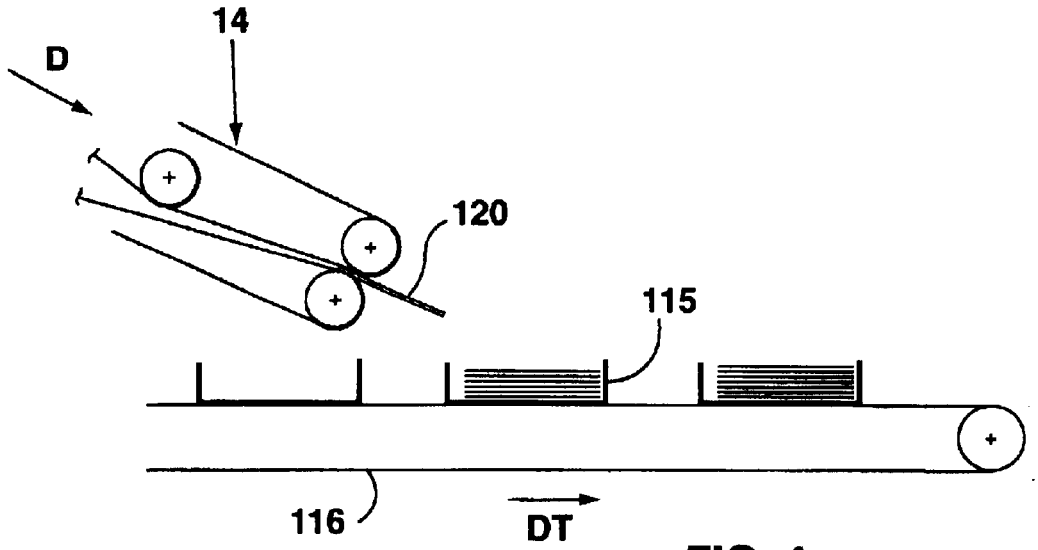
FIG. 4 is a schematic side view of another embodiment of this invention.
Figure 5:
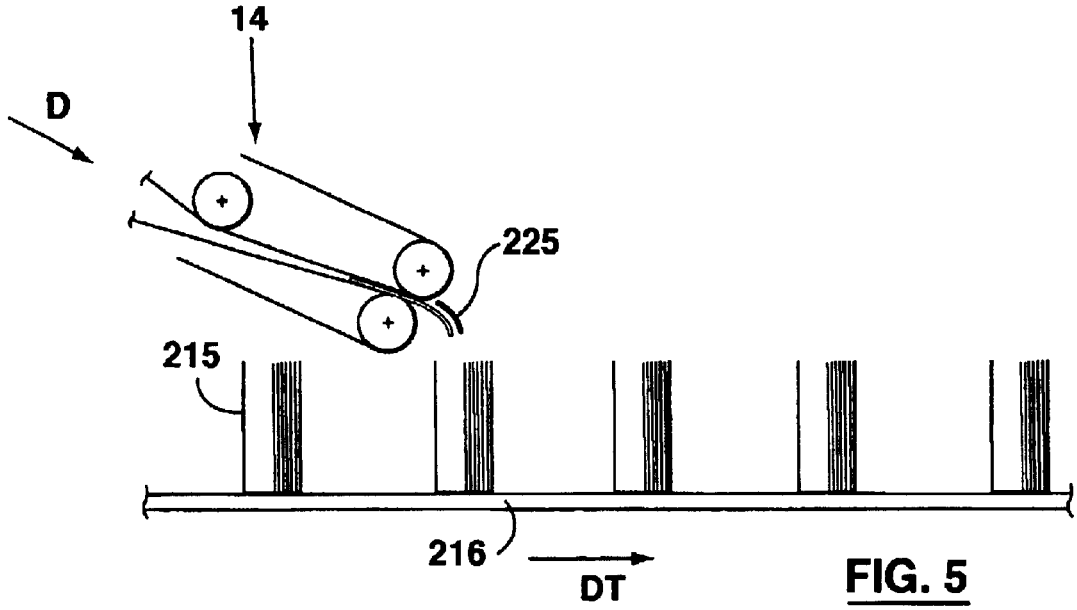
FIG. 5 is a schematic side view of yet another embodiment of this invention.

Optionally, the flight conveyor 16 could move substantially in downstream direction D, rather than transversely to this downstream direction as is shown in FIG. 1. For example, with reference to FIG. 4, a conveyor 116 conveys target boxes 115 in a target downstream direction DT. Target downstream direction DT crosses downstream direction D at a batch insertion station where a batch 120 is inserted into an open top of a box 115. In this regard, conveyor 116 may operate continuously and the batch sheet feeder 14 controlled so that it ejects batches at a speed matched to that of the conveyor 116. As a further example, with reference to FIG. 5, a batch deflector 225 is added to the output end of batch sheet feeder 14. A conveyor 216 conveys boxes 215 in a downstream direction DT that crosses downstream direction D at a batch insertion station. The batch sheet feeder 14 is controlled so that a batch is projected with sufficient speed to be inserted into the open top of a box 215 as it passes. Again, the speed of feeding batches may be controlled to match that of a continuously operating conveyor. Unlike drop table batch sheet feeders, there is no requirement to feed to a target only from directly above; also, the speed of feeding may be greater than what can be achieved by gravity. And unlike batch feeders that stack a batch directly on to a target, there is no need to stop the target while the batch is fed. It will be apparent that, in fact, if desired, batch sheet feeder 14 may feed batches at high speed. This allows the batch sheet feeder 14 to place batches onto, or into, targets that continuously move past the exit rolls 56, 58. Further, these targets may move in, or substantially in, the downstream direction D of the batch sheet feeder 14.

Figure 6:
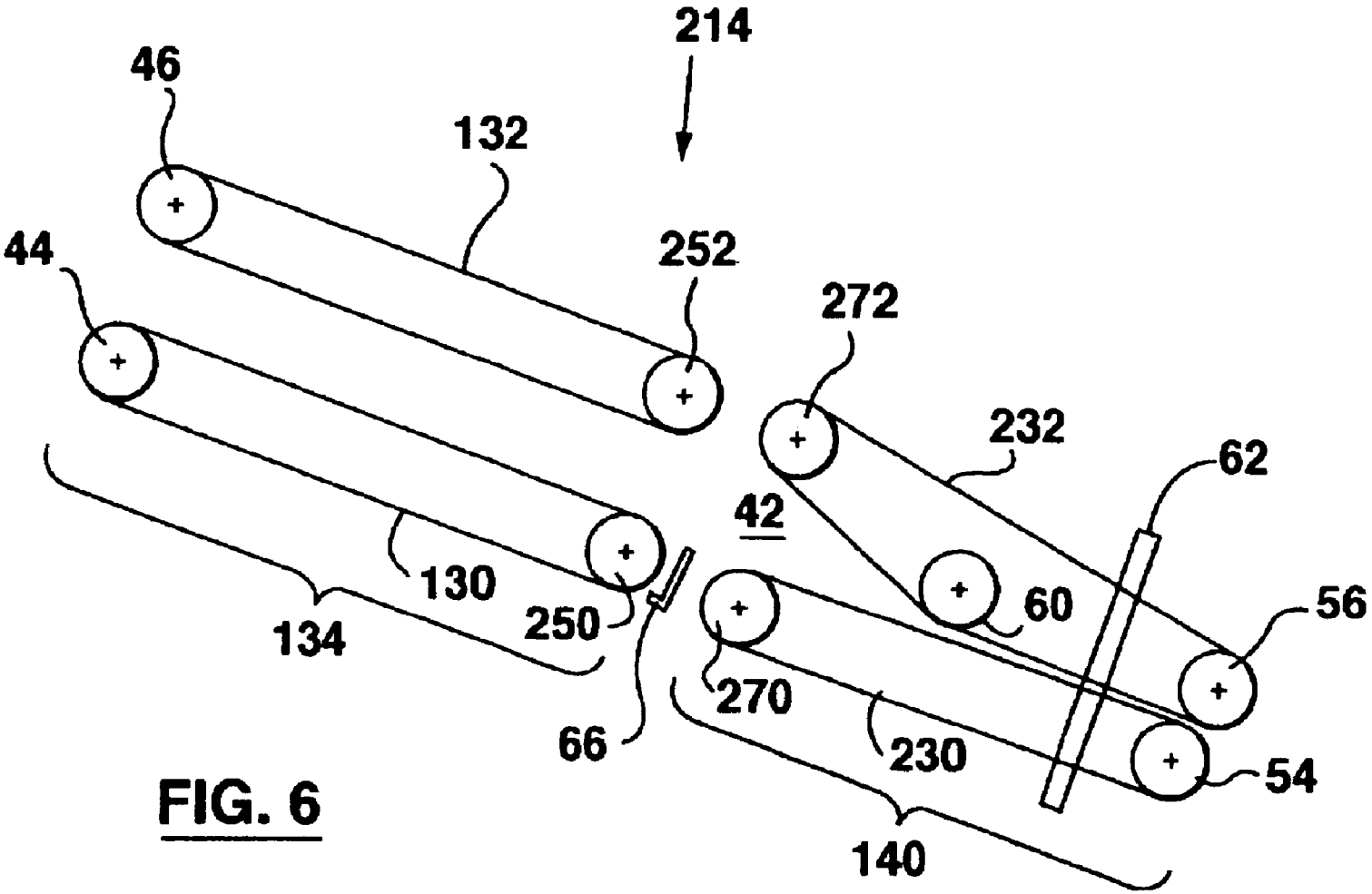
FIG. 6 is a schematic side view of a further embodiment of this invention.

FIG. 6 wherein illustrates alternate arrangement for the batch sheet feeder. Turning to FIG. 6 wherein like parts have been given like reference numerals, batch sheet feeder 214 differs from batch sheet feeder 14 of FIGS. 1 to 5 in that the downstream second section 40 is separate from the upstream first section 34. More particularly, the upstream section 34 is defined by conveyors 130, 132 which ride on rolls 44, 250, and 46, 252, respectively. And the downstream section 40 is defined by conveyors 230, 232 which ride on rolls 270, 54, and 272, 56, respectively. A suitable drive train may operatively couple the conveyors of the upstream section with those of the downstream section. With separate upstream 34 and downstream 40 sections, batch sheet feeder 214 omits the separating rolls 36, 38 of FIGS. 1 to 4 and so the length of the downstream section 40 is not readily adjustable. In other respects, the batch sheet feeder 214 operates in the same manner as batch sheet feeder 14 of FIGS. 1 to 5 with sheets feeding singly along the upstream section and dropping into gap 42 and accumulating as a batch.

In the batch sheet feeder 214 of FIG. 6, the upper conveyor 132 could be replaced with a stationary sheet guide.

Where the sheets of a batch are visually different, the visual attribute sensor 86 may be used to help ensure each batch is properly constituted. For example, each sheet of a batch may have a different pattern of colours. This could occur where, for example, each sheet of a batch is a different advertisement. For such batches, the visual attribute sensor 86 could be the aforedescribed colour sensor.

Typically, sheets of a batch are printed such that each batch has the same set of sheets (e.g., the same set of advertisements) in the same order. To verify such batches, an area of one sheet (the "target" sheet) of a model batch is selected that is coloured distinctly from the same area of all other sheets of the batch. The target sheet will have a certain ordinal position in the batch. The processor 90 is then prompted to advance sheets of the first batch until the target sheet from the first batch (i.e., the sheet in the first batch that is at the certain ordinal position) is at a given downstream position. Colour sensor 82 is then moved in its mount 85 so that its field of view is aligned with the selected area of the target sheet; the colour sensor is then locked in its mount in that position. With the selected area of the target sheet within the field of view of the colour sensor, the colour sensor is prompted to memorise the colour(s) of that area of the target sheet. The processor is also prompted to memorise the ordinal position of the target sheet in the batch.

Conveniently, the sheet sensor 82 sends a signal to processor 90 each time it senses (a leading or trailing) edge of a sheet (such that the processor counts one sheet after receiving two consecutive signals from sheet sensor 82). In such case, the given downstream location of the target sheet can be defined as the position at which the sheet sensor 86 senses the leading edge of the target sheet.

After the processor has memorised the noted parameters (of colour and ordinal position), whenever a batch is fed, the processor monitors for the leading edge of the target sheet (i.e., the sheet at the memorised ordinal position) in the batch and prompts sensor 82 to capture the colour of the selected area of that sheet. Provided the target sheet is, in fact, the intended sheet, the colour sensor will output a "match" signal. On the other hand, if the target sheet is not the intended sheet, the colour of the target sheet at the selected area will not match the memorised colour. In consequence, the processor will not receive the expected "match" signal. This will cause the processor to flag the current batch as faulty so that appropriate action can be taken.

While the example visual attribute sensor 82 is a colour sensor, other visual attribute sensors may be used. For example, the visual attribute sensor may be a visual pattern sensor for sensing the visual pattern within its field of view in addition to, or instead of, the colour. For example, the sensor could include a camera (such as a CCD camera) and output a "match" signal only when the (coloured) pattern within the field of view of the camera matched a memorised pattern. Alternatively, where the sheets included bar codes, the visual attribute sensor could be a bar code reader. Also, instead of the visual attribute sensor being a separate component, the sensor could be a combination of a visual sensor, such as a camera (at the location of sensor 86) and the processor 90. That is, the processor could process signals from a camera in order to store an initial (coloured) pattern and compare it with a current pattern.

Optionally, a visual attribute of more than one sheet, or indeed of all sheets, of a batch may be memorised and used as a metric of comparison with corresponding sheets of future batches to identify faulty batches. As a further option, the last sheet in each batch may be provided with a visible end-of-batch indicia positioned so that it will be in the field of view of the visual attribute sensor as this last sheet passes the sensor. In such instance, the processor learns from the sensor that the last sheet of a batch has been fed. Consequently, there is no need for the processor to be pre-loaded with the batch size and, indeed, this size may change from batch to batch.

Adjustable support roll 60 could be replaced with an adjustable support abutment having a low friction surface that makes sliding contact with the upper conveyor 32.

Other modifications will be apparent to those skilled in the art and, therefore, the invention is defined in the claims.

What is claimed is:

1. A batch sheet feeder comprising:

an upstream first conveyor section arranged to convey sheets singly in a downstream direction to a downstream second conveyor section;

said second conveyor section comprised of an upper second conveying belt and a lower second conveying belt forming a gap therebetween, said gap being largest at an upstream end of said second conveyor section and diminishing in size toward a downstream end of said second conveyor section;

a gate positioned proximate said downstream end of said second conveyor section for selectively blocking sheets from exiting said second conveyor section; and an adjustable support for adjusting a portion of said upper second conveying belt from a first position away from said lower conveying belt to a second position toward said lower second conveying belt in order to selectively adjust a size of said gap.

2. The feeder of claim 1 including a sheet sensor positioned along said first conveyor section.

3. The feeder of claim 2 including a batch sensor positioned along said second conveyor section.

4. The feeder of claim 2 further comprising a visual attribute sensor having a field of view covering an area of said first conveyor section at a certain downstream location so as to sense an area of any sheet at said downstream location.

5. The feeder of claim 4 further comprising a processor receiving an output from said visual attribute sensor and said sheet sensor.

6. The feeder of claim 5 wherein said one of said processor and said visual attribute sensor has an input for prompting the memorisation of a visual attribute within said field of view of said visual attribute sensor.

7. The feeder of claim 5 further comprising a mount for said visual attribute sensor permitting adjustment of said visual attribute sensor in said downstream direction and transversely of said downstream direction.

8. The feeder of claim 6 wherein said processor is for determining an error condition based on a timing of receipt of visual attribute signals received from said visual attribute sensor and sheet sensing signals from said sheet sensor.

9. The feeder of claim 8 wherein said determining comprises counting sheets based on sheet sensing signals received from said sheet sensor.

10. The feeder of claim 9 wherein said processor determines said error condition if a memorised visual attribute is not detected when a count of sheets is at a pre-set count.

11. The feeder of claim 1 wherein a downstream end of said upper second conveying section is supported by an upper undulating roll and a downstream end of said lower second conveying section is supported by a parallel lower undulating roll such that peaks of said upper undulating roll are aligned with troughs of said lower undulating roll.

12. The feeder of claim 11 wherein peaks of each undulating roll have crowns.

13. A batch sheet feeder comprising:

an upstream first conveyor section arranged to convey sheets singly in a downstream direction to a downstream second conveyor section;

said second conveyor section comprised of an upper second conveying section and a lower second conveying section forming a gap therebetween, said gap being largest at an upstream end of said second conveyor section and diminishing in size toward a downstream end of said second conveyor section;

a gate positioned proximate said downstream end of said second conveyor section for selectively blocking sheets from exiting said second conveyor section;

wherein said upstream first conveyor section and said downstream second conveyor section are comprised of an upper endless conveyor and a lower endless conveyor, said lower conveyor substantially paralleling said upper conveyor along said first section, said lower conveyor jogging away from said upper conveyor at an upstream end of said second section so as to form said gap;

at least two support rolls around which said lower conveyor wraps so as to cause said jogging away of said lower conveyor, wherein said at least two support rolls comprise a downstream support roll and an upstream support roll and wherein said lower conveyor wraps around a downstream side of said downstream support roll and around an upstream side of said upstream support roll and wherein said upstream support roll is upstream of said downstream support roll.

14. A batch sheet feeder, comprising:

a lower endless conveyor, an upper endless conveyor arranged with respect to said lower conveyor so as to form a sheet feed path between said lower conveyor and said upper conveyor for feeding sheets in a downstream direction;

said lower conveyor substantially paralleling said upper conveyor along an upstream first section, said lower conveyor jogging away from said upper conveyor at an upstream end of a downstream second section so as to form a gap between said lower conveyor and said upper conveyor at said second section that is larger than any gap between said lower conveyor and said upper conveyor at said first section;

at least two support rolls around which said lower conveyor wraps so as to cause said jogging away of said lower conveyor, wherein said at least two support rolls comprise a downstream support roll and an upstream support roll and wherein said lower conveyor wraps around a downstream side of said downstream support roll and around an upstream side of said upstream support roll and wherein said upstream support roll is upstream of said downstream support roll.

15. The feeder of claim 14 wherein said second section gap is largest at an upstream end of said second section and reduces in size toward a downstream end of said second section.

16. The feeder of claim 15 further comprising an adjustable support for adjusting a portion of said upper conveyor toward and away from said lower conveyor, said adjustable support positioned between said at least two support rolls and a downstream end of said second section.

17. A method of feeding sheets, comprising:

conveying sheets singly in a downstream direction to a conveyor section having an upper endless belt and a lower endless belt forming a gap therebetween, said gap being largest at an upstream end of said conveyor section and diminishing in size toward a downstream end of said conveyor section;

pressing said upper endless belt toward said lower endless belt between said upstream end of said conveyor section and said downstream end of said conveyor section in order to form a bend in said upper endless belt such that sheets entering said gap bend so that as a trailing edge of a sheet enters said gap, said trailing edge is urged downwardly as said sheet naturally begins to straighten out.

* * * * *